US008126152B2

(12) United States Patent
Taleb

(10) Patent No.: US 8,126,152 B2
(45) Date of Patent: Feb. 28, 2012

(54) METHOD AND ARRANGEMENT FOR A DECODER FOR MULTI-CHANNEL SURROUND SOUND

(75) Inventor: Anisse Taleb, Kista (SE)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 785 days.

(21) Appl. No.: 12/295,172

(22) PCT Filed: Mar. 28, 2007

(86) PCT No.: PCT/SE2007/050194

§ 371 (c)(1),
(2), (4) Date: Sep. 29, 2008

(87) PCT Pub. No.: WO2007/111568

PCT Pub. Date: Oct. 4, 2007

(65) Prior Publication Data

US 2009/0110203 A1 Apr. 30, 2009

Related U.S. Application Data

(60) Provisional application No. 60/743,871, filed on Mar. 28, 2006.

(51) Int. Cl.
*H04R 5/00* (2006.01)

(52) U.S. Cl. ..... 381/17

(58) Field of Classification Search ..... 381/1, 17, 381/18, 19

See application file for complete search history.

(56) References Cited

U.S. PATENT DOCUMENTS

| | | | | |
|---|---|---|---|---|
| 7,254,239 | B2 * | 8/2007 | Fincham | 381/17 |
| 7,606,716 | B2 * | 10/2009 | Kraemer | 704/500 |
| 2004/0008847 | A1 * | 1/2004 | Kim | 381/18 |

* cited by examiner

*Primary Examiner* — Hung Vu

(57) ABSTRACT

The basic concept of the present invention is to extrapolate a partially known spatial covariance matrix of a multi-channel signal in the parameter domain. The extrapolated covariance matrix is used with the downcoded downmix signal in order to efficiently generate an estimate of a linear combination of the multi-channel signals.

20 Claims, 11 Drawing Sheets

METHOD AND ARRANGEMENT FOR A DECODER FOR MULTI-CHANNEL SURROUND SOUND

This application claims the benefit of U.S. Provisional Application No. 60/743,871, filed Mar. 28, 2006, the disclosure of which is fully incorporated herein by reference.

TECHNICAL FIELD

The present invention relates to decoding of a multi-channel surround audio bit stream. In particular, the present invention relates to a method and arrangement that uses spatial covariance matrix extrapolation for signal decoding.

BACKGROUND

In film theaters around the world, multi-channel surround audio systems have since long placed film audiences in the center of the audio spaces of the film scenes that are being played before them and are giving them a realistic and convincing feeling of "being there". This audio technology has moved into the homes of ordinary people as home surround sound theatre systems and is now providing them with the sense of "being there" in their own living rooms.

The next field where this technology will be used includes mobile wireless units or terminals, in particular small units such as cellular phones, mp3-players (including similar music players) and PDAs (Personal Digital assistants). There the immersive nature of the surround sound is even more important because of the small screens. Moving this technology to the mobile terminal is, however, not a trivial matter. The main obstacles include that:

The available bit-rate is in many cases low especially in wireless mobile channels.

The processing power of the mobile terminal is rather limited.

Small mobile terminals generally have only two micro speakers and ear-plugs or headphones.

This means, in particular for mobile terminals such as cellular phones, that a surround sound solution on a mobile terminal has to use a much lower bit-rate than for example the 384 kbits/sec that is used in the Dolby Digital 5.1 system. Due to the limited processing power, the decoders of the mobile terminals must be computationally optimized and due to the speaker configuration of the mobile terminal the surround sound must be delivered through the earplugs or headphones.

A standard way of delivering multi-channel surround sound through headphones or earplugs is to perform a 3D audio or binaural rendering of the multichannel surround sound.

In general, in 3D audio rendering a model of the audio scene is used and each incoming monophonic signal is filtered through a set of filters that model the transformations created by the human head, torso and ears. These filters are called head related filters (HRF) having head related transfer functions (HRTFs) and if appropriately designed, they give a good 3D audio scene perception.

The diagram of FIG. 1 illustrates a method of complete 3D audio rendering of a multichannel 5.1 audio signal. The six multi-channel signals are:

surround right (SR), right (R), center (C), low frequency element (LFE), left (L) and surround left (SL).

In the example illustrated in FIG. 1 the center and low frequency signals are combined into one signal. Then, five different filters denoted: $H_I^B$, $H_C^B$, $H^C$, $H_I^F$ and $H_C^F$ are needed in order to implement this method of head related filtering. The SR signal is input to filters $H_I^B$ and $H_C^B$, the R signal is input to filters $H_I^F$ and $H_C^F$, the C and LFE signals are jointly input to filter $H^C$, the L signal is input to filters $H_I^F$ and $H_C^F$ and the SL signal is input to filters $H_I^B$, $H_C^B$. The signals output from the filters $H_I^B$, $H_C^B$, $H^C$, $H_I^F$ and $H_C^F$ are summed in a right summing element 1R to give a signal intended to be provided to the right headphone, not shown. The signals output from the filters $H_I^B$, $H_C^B$, $H^C$, $H_C^F$ and $H_C^F$ are summed in a left summing element 1L to give a signal intended to be provided to the left headphone, not shown. In this case a symmetric head is assumed, therefore the filters for the left ear and the right ear are assumed to be similar.

The quality in terms of 3D perception of such rendering depends on how closely the HRFs model or represent the listener's own head related filtering when she/he is listening. Hence, it may be advantageous if the HRFs can be adapted and personalized for each listener if a good or very good quality is desired. This adaptation and personalization step may include modeling, measurement and in general a user dependent tuning in order to refine the quality of the perceived 3D audio scene.

Current state-of-the-art standardized multi-channel audio codecs require a high amount of bandwidth in order to reach an acceptable quality and thus they prohibit the use of such codec for services such as wireless mobile streaming.

For instance, even if the Dolby Digital 5.1 (AC-3 codec) has very low complexity when compared to the AAC (Advanced Audio Coding) multi-channel codec, it requires much more bit-rate for similar quality. Both codecs, the AAC multi-channel codec and AC-3 codec remain until today unusable in the wireless mobile domain because of the high demands that they make on computational complexity and bit-rate.

New parametric multi-channel codecs based on the principles of binaural cue coding have been developed. The recently standardized MPEG parametric stereo tool is a good example of the low complexity/high quality parametric techniques for encoding stereo sound. The extension of parametric stereo to multi-channel coding is currently undergoing standardization in MPEG under the name Spatial Audio coding, and is also known as MPEG-surround.

The principles behind the parametric multi-channel coding can be explained and understood from the block diagram of FIG. 2 that illustrates a general case.

The parametric surround encoder 3, also referred to as a multi-channel parametric surround encoder, receives a multi-channel audio signal comprising the individual signals $x_1(n)$ to $x_N(n)$, where N is the number of input channels. The encoder 3 then forms in down-mixing unit 5 a down-mixed signal comprising the individual down-mixed signals $z_1(n)$ to $z_M(n)$. The number of down mixed channels M<N is dependent upon the desired bit-rate, quality and the availability of an M-channel audio encoder 7. One key aspect of the encoding process is that the down-mixed signal, typically a stereo signal but it could also be a mono signal, is derived from the multi-channel input signal, and it is this down mix signal that is compressed in the audio encoder 7 for transmission over the wireless channel 11 rather than the original multi-channel signal. In addition, the parametric surround encoder also comprises a spatial parameter estimation unit 9 that from the input signals $x_1(n)$ to $x_N(n)$ computes the spatial cues or spatial parameters such as inter-channel level differences, time differences and coherence. The compressed audio signal which is output from the M-channel audio encoder (main signal) is, together with the spatial parameters that constitute side information transmitted to the receiving side that in the case considered here typically is a mobile terminal.

On the receiving side, a parametric surround decoder 13 includes an M-channel audio decoder 15. The audio decoder 15 produces signals $\hat{z}_1(n)$ to $\hat{z}_M(n)$ that the coded version of $z_1(n)$ to $z_M(n)$. These are together with the spatial parameters input to a spatial synthesis unit 17 that produces output signals $\hat{x}_1(n)$ to $\hat{x}_N(n)$. Because the decoding process is parametric in nature, the decoded signals $\hat{x}_1(n)$ to $\hat{x}_N(n)$ are not necessarily objectively close to the original multichannel signals $x_1(n)$ to $x_N(n)$ but are subjectively a faithful reproduction of the multichannel audio scene.

It is obvious, that depending on the bandwidth of the transmitting channel over the interface 11 that generally is relatively low there will be a loss of information and hence the signals $\hat{z}_1(n)$ to $\hat{z}_M(n)$ and $\hat{x}_1(n)$ to $\hat{x}_N(n)$ on the receiving side cannot be the same as their counterparts on the transmitting side. Even though they are not quite true equivalents of their counterparts, they may be sufficient good equivalents.

In general, such a surround encoding process is independent of the compression algorithm used in the units encoder 7 (core encoder) and the audio decoder 15 (core decoder) in FIG. 2. The core encoding process can use any of a number of high performance compression algorithms such as AMR-WB+ (extended adaptive multirate wide band), MPEG-1 Layer III (Moving Picture Experts Group), MPEG-4 AAC or MPEG-4 High Efficiency AAC, and it could even use PCM (Pulse Code Modulation).

In general, the above operations are done in the transformed signal domain, such as Fourier transform and in general on some time-frequency decomposition. This is especially beneficial if the spatial parameter estimation and synthesis in the units 9 and 17 use the same type of transform as that used in the audio encoder 7.

FIG. 3 is a detailed block diagram of an efficient parametric audio encoder. The N-channel discrete time input signal, denoted in vector form as $x_N(n)$, is first transformed to the frequency domain in a transform unit 21 that gives a signal $\bar{x}_N(k, m)$. The index k is the index of the transform coefficients, or frequency sub-bands. The index m represents the decimated time domain index that is also related to the input signal possibly through overlapped frames.

The signal is thereafter down-mixed in a down-mixing unit 5 to generate the M-channel down mix signal $z_M(k, m)$, where $M<N$. A sequence of spatial model parameter vectors $p_N(k, m)$ is estimated in an estimation unit 9. This can be either done in an open-loop or closed loop fashion.

The spatial parameters consist of psycho-acoustical cues that are representative of the surround sound sensation. For instance, these parameters consist of inter-channel level differences (ILD), time differences (ITD) and coherence (IC) to capture the spatial image of a multi-channel audio signal relative to a transmitted down-mixed signal $z_M(k, m)$ (or if in closed loop, the decoded signal $\tilde{z}_M(k, m)$). The cues $p_N(k, m)$ can be encoded in a very compact form such as in a spatial parameter quantization unit 23 producing the signal $\tilde{p}_N(k, m)$ followed by a spatial parameter encoder 25. The M-channel audio encoder 7 produces the main bit stream which in a multiplexer 27 is multiplexed with the spatial side information produced by the parameter encoder. From the multiplexer the multiplexed signal is transmitted to a demultiplexer 29 on the receiving side in which the side information and the main bit stream are recovered as seen in the block diagram of FIG. 4.

On the receiving side the main bit stream is decoded to synthesize a high quality multichannel representation using the received spatial parameters. The main bit stream is first decoded in an M-channel audio decoder 31 from which the decoded signals $\hat{z}_M(k, m)$ are input to the spatial synthesis unit 17. The spatial side information holding the spatial parameters is extracted by the demultiplexer 29 and provided to a spatial parameter decoder 33 that produces the decoded parameters $\tilde{p}_N(k, m)$ and transmits them to the synthesis unit 17. The spatial synthesis unit produces the signal $\tilde{x}_N(k, m)$, that is provided to the signal Frequency-to-time transform unit 35 to produce the signal $\hat{x}_N(k, m)$, i.e. the multichannel decoded signal.

A personalized 3D audio rendering of a multi-channel surround sound can be delivered to a mobile terminal user by using an efficient parametric surround decoder to first obtain the multiple surround sound channels, using for instance the multi-channel decoder described above with reference to FIG. 4. Thereupon, the system illustrated in FIG. 1 is used to synthesize a binaural 3D-audio rendered multichannel signal. This operation is shown in the schematic of FIG. 5.

Work has also been done in which spatial or 3D audio filtering has been performed in the subband domain. In C. A. Lanciani, and R. W. Schafer, "Application of Head-related Transfer Functions to MPEG Audio Signals", Proc. 31st Symposium on System Theory, Mar. 21-23, 1999, Auburn, Ala., U.S.A., it is disclosed how an MPEG coded mono signal could be spatialized by performing the HR filtering operation in the subband domain. In A. B. Touimi, M. Emerit and J. M. Pernaux, "Efficient Method for Multiple Compressed Audio Streams Spatialization," Proc. 3rd International Conference on Mobile and Ubiquitous Multimedia, pp. 229-235, Oct. 27-29, 2004, College Park, Md., U.S.A., it is disclosed how a number of individually MPEG coded mono signals can be spatialized by doing the Head Related (HR) filtering operations in the subband domain. The solution is based on a special implementation of the HR filters, in which all HR filters are modeled as a linear combination of a few predefined basis filters.

Applications of 3D audio rendering are multiple and include gamming, mobile TV shows, using standards such as 3GPP MBMS or DVB-H, listening to music concerts, watching movies and in general multimedia services, which contain a multi-channel audio component.

The methods described above of rendering multi-channel surround sound, although attractive since they allow a whole new set of services to be provided to wireless mobile units, have many drawbacks:

First of all, the computational demands of such rendering are prohibitive since both decoding and 3D rendering have to be performed in parallel and in real time. The complexity of a parametric multi-channel decoder even if low when compared to a full waveform multi-channel decoder is still quite high and at least higher than that of a simple stereo decoder. The synthesis stage of spatial decoding has a complexity that is at least proportional to the number of encoded channels. Additionally, the filtering operations of 3D rendering are also proportional to the number of channels.

The second disadvantage consists of the temporary memory that is needed in order to store the intermediate decoded channels. They are in fact buffered since they are needed in the second stage of 3D rendering.

Finally, one of the main disadvantages is that the quality of such 3D audio rendering can be very limited due to the fact that inter-channel correlations may be canceled. The inter-channel correlations are essential due to the way parametric multi-channel coding synthesizes the signals.

In MPEG surround, for instance, the correlations (ICC) and channel level differences (CLD) are estimated only between pairs of channels. The ICC- and the CLD-parameters are encoded and transmitted to the decoder. In the decoder, the received parameters are used in a synthesis tree as depicted in FIG. 7 for one 5-1-5 configuration (in this case the 5-1-$5_1$ configuration). FIG. 6 illustrates surround system configuration having 5-1-$5_1$ parameterization. From FIG. 6 it can be seen that CLD and ICC parameters in the 5-1-$5_1$ configuration are estimated only between pairs of channels.

Due to that the correlations (ICC) and channel level differences (CLD) are only estimated between pairs of channels, not all single correlations are available. This in turn prohibits individual channel manipulation and re-use, as for instance, 3D rendering. In fact, if for instance two un-coded channels, for example RF and RS are uncorrelated and they are encoded by using the 5-1-$5_1$ configuration, then no control over their correlation is available since the correlation is simply not transmitted to the decoder as such but only the correlation on the second level of the tree is provided. At the decoder side, this in turn would lead to two correlated decoded channels. In fact, the decoder does not have access, nor does it have control over the correlation between certain individual channels. These channels belong to different third level boxes. In the example of FIG. 6, these are all pairs of channels which belong to different loudspeaker groupings. This can also be seen in FIG. 7. The pairs of channels are the ones which belong to different third-level tree boxes (OTT3, OTT4 OTT2) in the 5-1-$5_1$ configuration. This may not be a problem when listening in a loudspeaker environment; however it becomes a problem if the channels are combined together, as in 3D rendering, leading to possible unwanted channel cancellation or over-amplification.

SUMMARY

The object of the present invention is to overcome the disadvantages in parametric multichannel decoders related to possible unwanted cancellation and/or amplification of certain channels. That is achieved by rendering arbitrary linear combinations of the decoded multichannel signals by extrapolating a partially known covariance to a complete covariance matrix of all the channels and synthesizing based on the extrapolated covariance an estimate of the arbitrary linear combinations.

According to a first aspect of the present invention, a method for synthesizing an arbitrary predetermined linear combination of a multi-channel surround audio signal is provided. The method comprises the steps of receiving a description H of the arbitrary predetermined linear combination, receiving a decoded downmix signal of the multi-channel surround audio signal, receiving spatial parameters comprising correlations and channel level differences of the multi-channel audio signal, obtaining a partially known spatial covariance based on the received spatial parameters comprising correlations and channel level differences of the multi-channel audio signal, extrapolating the partially known spatial covariance to obtain a complete spatial covariance, forming according to a fidelity criterion an estimate of said arbitrary predetermined linear combination of the multi-channel surround audio signal based at least on the extrapolated complete spatial covariance, the received decoded downmix signal and the said description of the arbitrary predetermined linear combination, and synthesizing said arbitrary predetermined linear combination of a multi-channel surround audio signal based on said estimate of the arbitrary predetermined linear combination of the multi-channel surround audio signal.

According to a second aspect, an arrangement for synthesizing an arbitrary predetermined linear combination of a multi-channel surround audio signal is provided. The arrangement comprises a correlator for obtaining a partially known spatial covariance based on received spatial parameters comprising correlations and channel level differences of the multi-channel audio signal, an extrapolator for extrapolating the partially known spatial covariance to obtain a complete spatial covariance, an estimator for forming according to a fidelity criterion an estimate of said arbitrary predetermined linear combination of the multi-channel surround audio signal based at least on the extrapolated complete spatial covariance, a received decoded downmix signal m and a description of the coefficients giving the arbitrary predetermined linear combination, and a synthesizer for synthesizing said arbitrary predetermined linear combination of a multi-channel surround audio signal based on said estimate of the arbitrary predetermined linear combination of the multi-channel surround audio signal.

Thus, the invention allows a simple and efficient way to render surround sound, which is encoded by parametric encoders on mobile devices. The advantage consists of a reduced complexity and increased quality than that which is obtained by using a 3D rendering directly on the multi-channel signals.

In particular, the invention allows arbitrary binaural decoding of multichannel surround sound.

A further advantage is that the operations are performed in the frequency domain thus reducing the complexity of the system.

A further advantage is that signal samples do not have to be buffered, since the output is directly obtained in a single decoding step.

DETAILED DESCRIPTION

The basic concept of the present invention is to obtain a partially known spatial covariance of a multi-channel surround audio signal based on received spatial parameters and to extrapolate the obtained partially known spatial covariance to obtain a complete spatial covariance. Then, according to a fidelity criterion, a predetermined arbitrary linear combination of the multi-channel surround audio signal is estimated based at least on the extrapolated complete spatial covariance, a received decoded down mix signal m and a description H of the predetermined arbitrary linear combination to be able to synthesize the predetermined linear combination of the multichannel surround audio signal based on said estimation. The predetermined arbitrary linear combination of the multichannel surround audio signal can conceptually be a representation of a filtering of the multichannel signals, e.g. head related filtering and binaural rendering. It can also represent other sound effects such as reverberation.

Figure 10A:
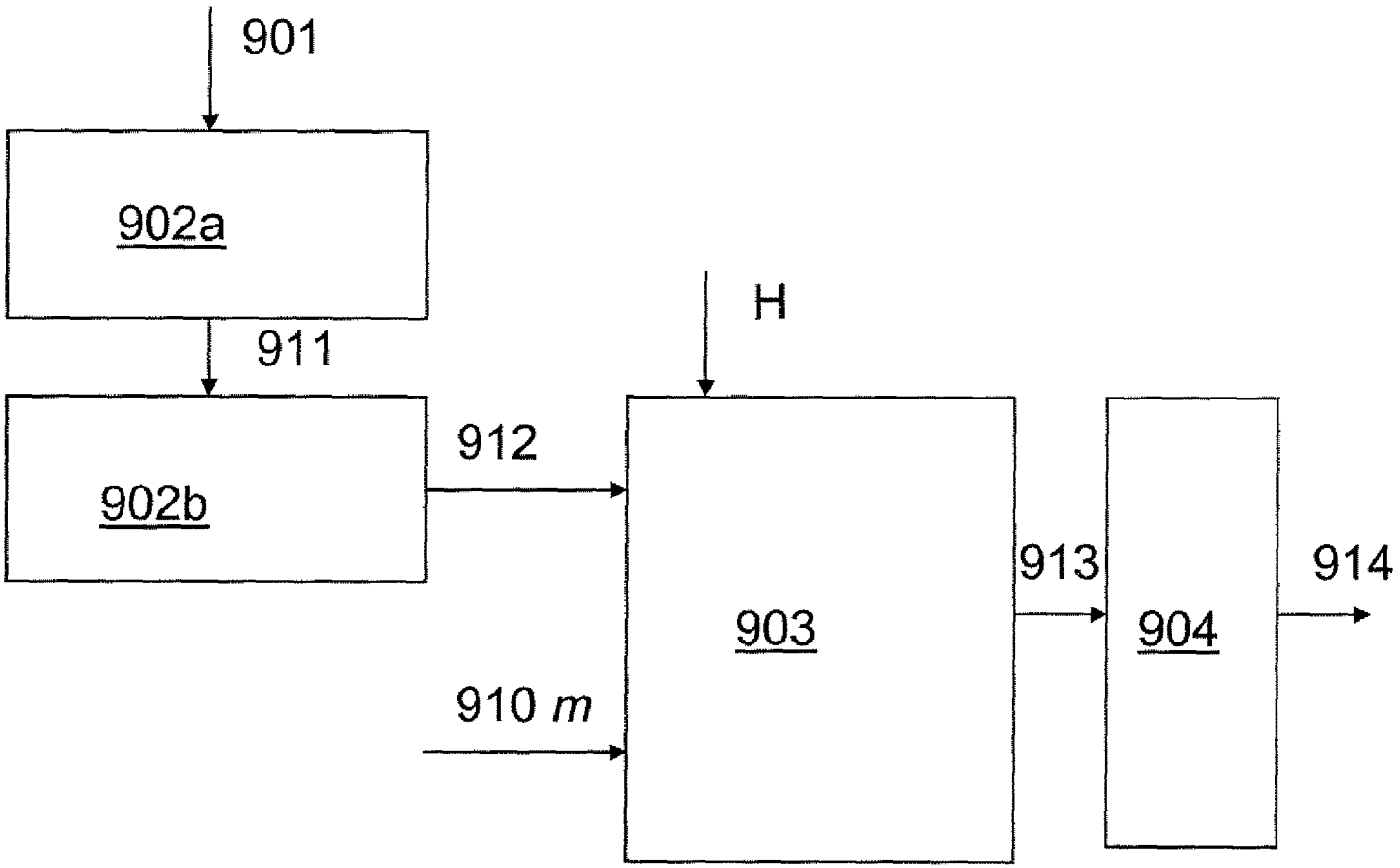
FIG. 10*a* illustrates the arrangement according to the present invention and FIG. 10*b* illustrates an embodiment of the invention.

Thus, the present invention relates to a method for a decoder and an arrangement for a decoder. The arrangement is illustrated in FIG. 10*a* and comprises a correlator 902*a*, an extrapolator 902*b*, an estimator 903 and a synthesizer 904. The correlator 902*a* is configured to obtain a partially known spatial covariance matrix 911 based on received spatial parameters 901 comprising correlations ICC and channel level differences CLD of the multi-channel surround audio signal. The extrapolator 902*b* is configured to use a suitable extrapolation method to extrapolate the partially known spatial covariance matrix to obtain a complete spatial covariance matrix. Further, the estimator 903 is configured to estimate according to a fidelity criterion a linear combination 913 of the multi-channel surround audio signal by using the extrapolated complete spatial covariance matrix 912 in combination with a received decoded downmix signal and a matrix $H^k$ of coefficients representing a description of the predetermined arbitrary linear combination. Finally the synthesizer 904 is configured to synthesize the linear combination 914 of the multi-channel surround audio signal based on said estimation 913 of the linear combination of the multi-channel surround audio signal.

A preferred embodiment of the present invention will now be described in relation to an MPEG surround decoder. It should be appreciated that although a preferred embodiment of the present information is described with reference to an MPEG surround decoder, other parametric decoders and systems may also suitable for use in connection with the present invention.

Figure 1:
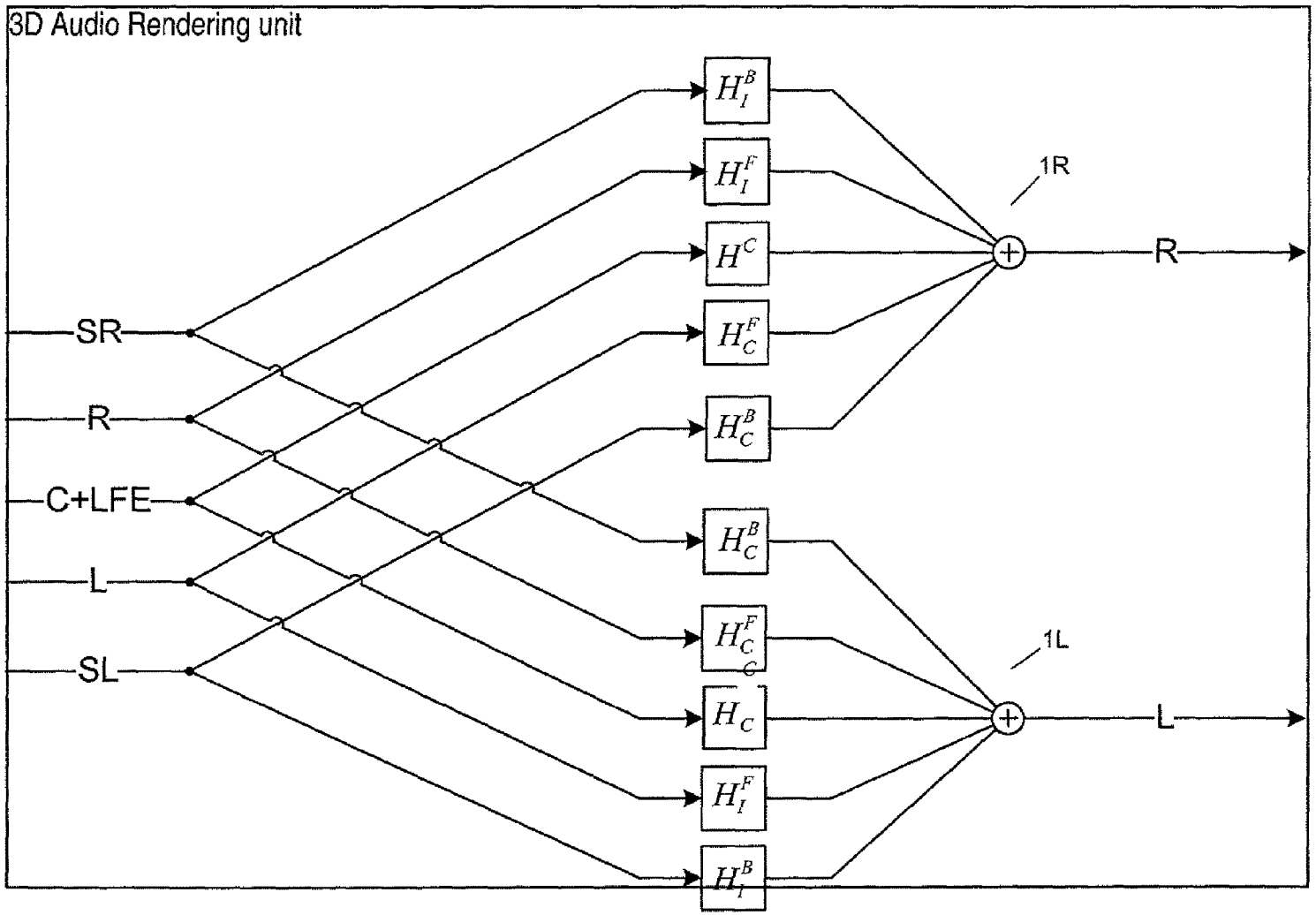
Fig. 1 Prior art
FIG. 1 is a block diagram illustrating a possible 3D audio or binaural rendering of a 5.1 audio signal.
Figure 2:
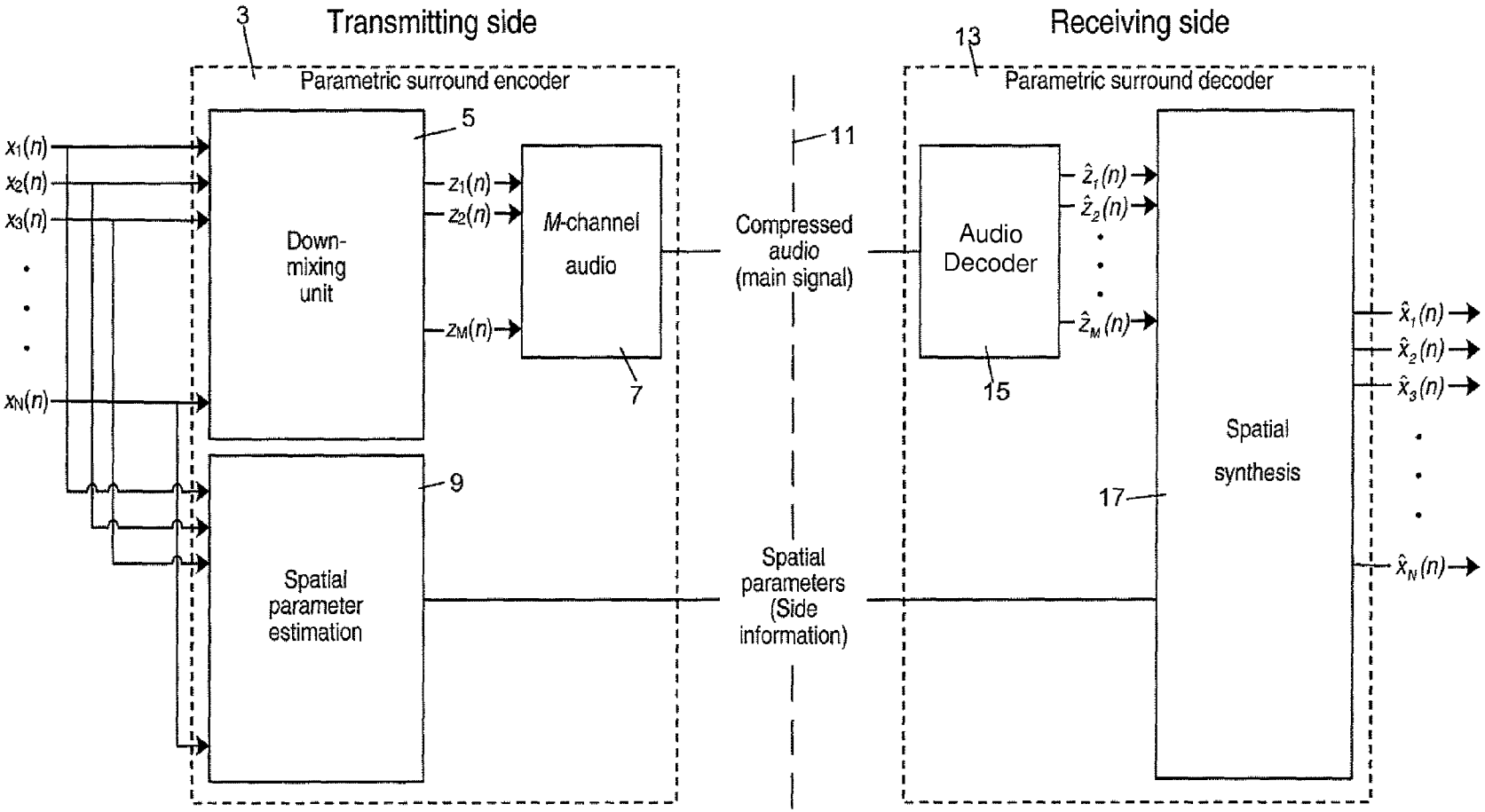
Fig. 2 Prior art
FIG. 2 is a high level description of the principles of a parametric multi-channel coding and decoding system.
Figure 3:
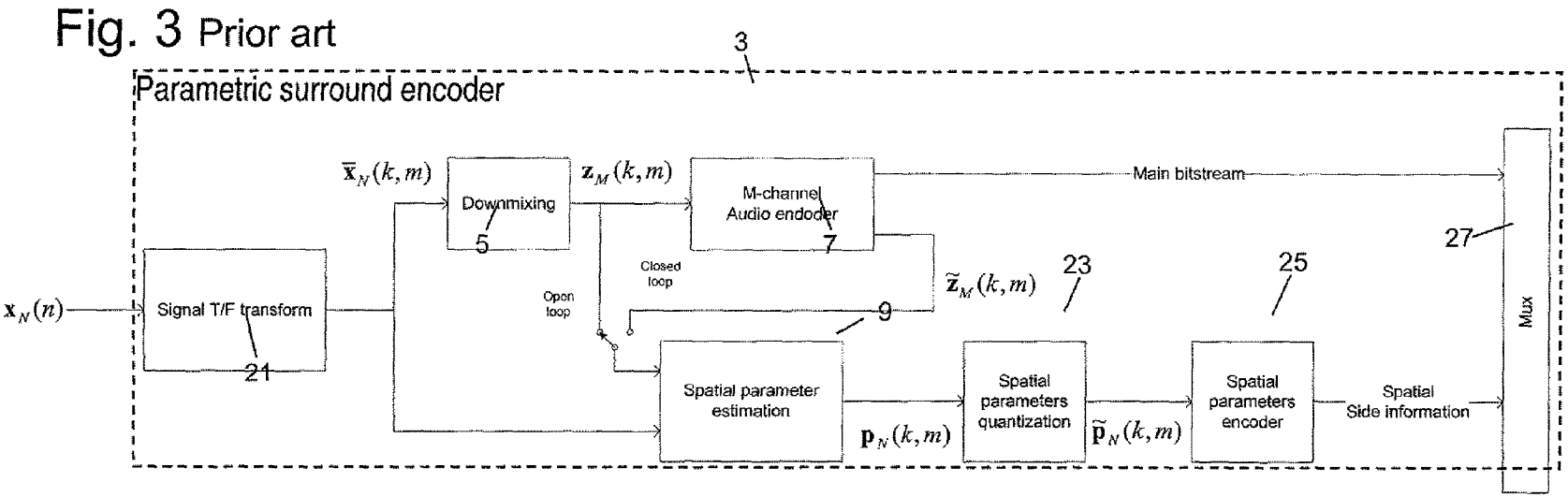
Fig. 3 Prior art
FIG. 3 is a detailed description of the parametric multi-channel audio encoder.
Figure 4:
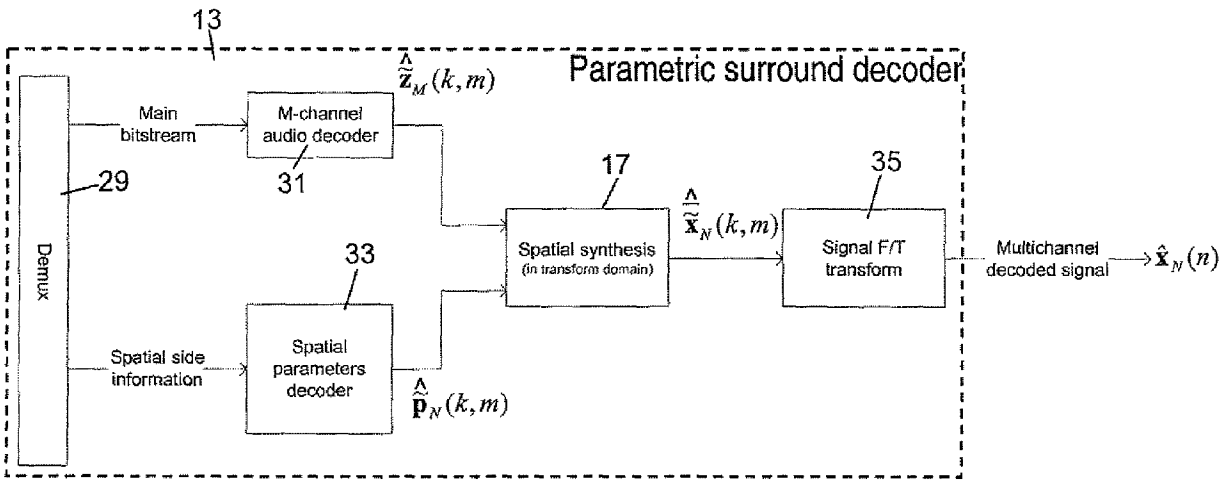
Fig. 4 Prior art
FIG. 4 is a detailed description of the parametric multi-channel audio decoder.
Figure 5:
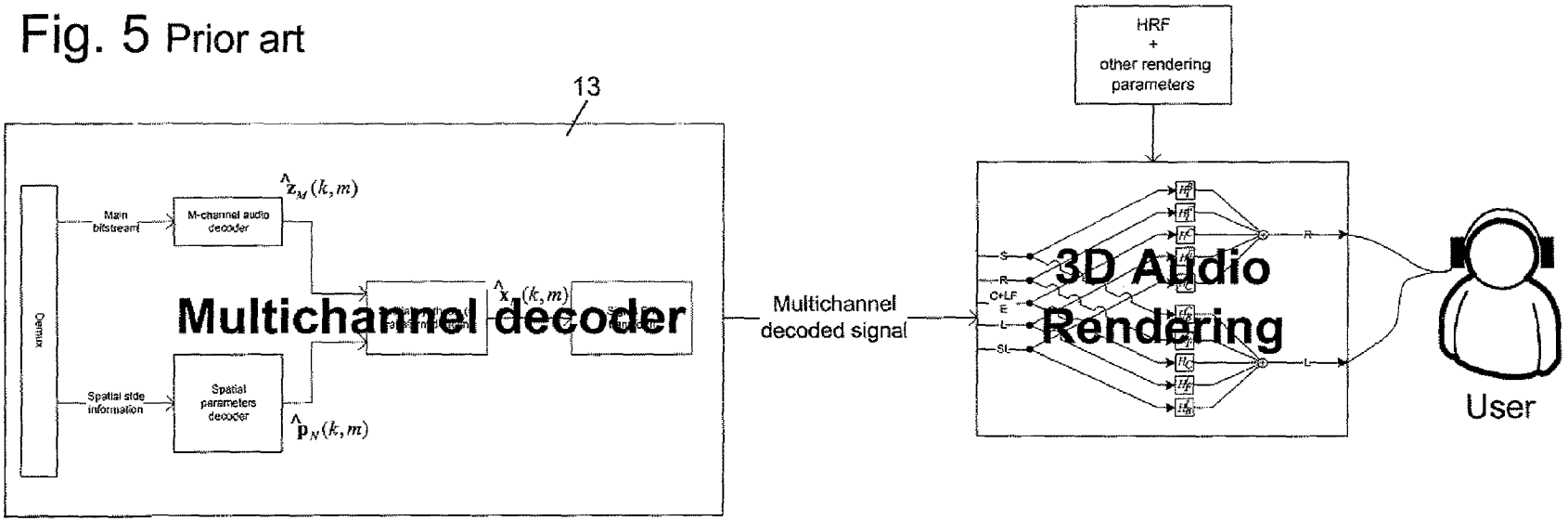
Fig. 5 Prior art
FIG. 5 is 3D-audio rendering of decoded multi-channel signal
Figure 6:
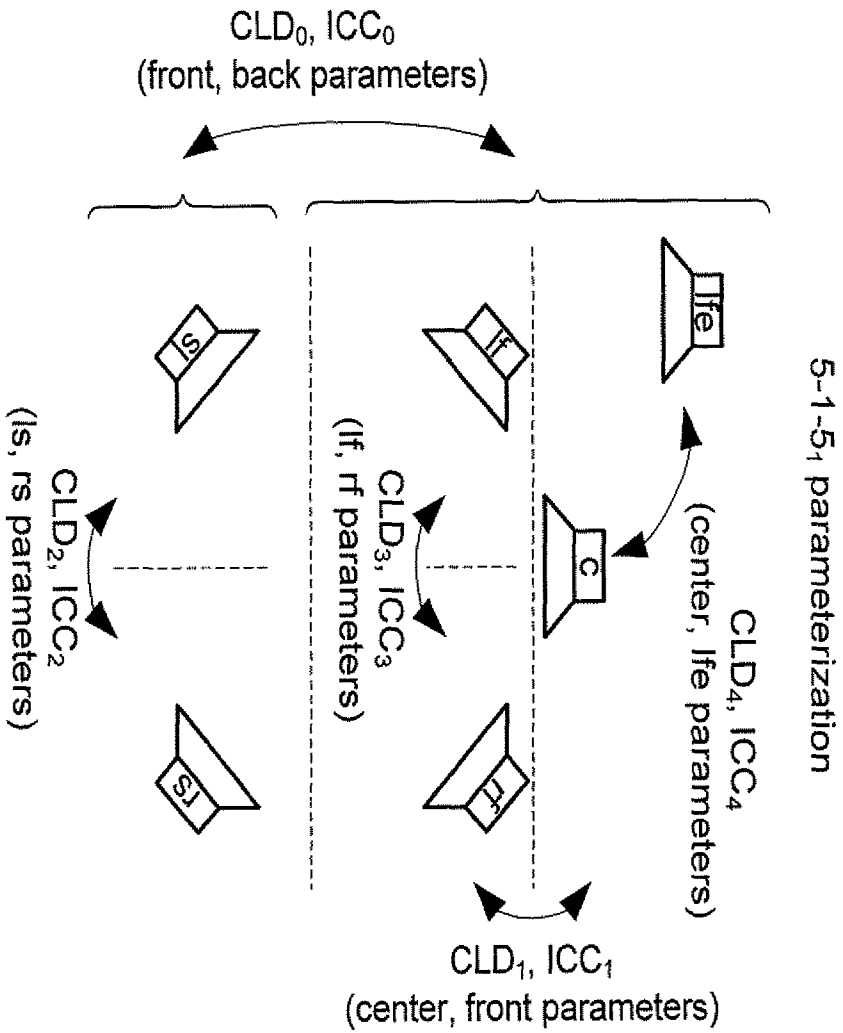
FIG. 6 is a parameterization view of the spatial audio processing for the 5-1-$5_1$ configuration.
Figure 7:
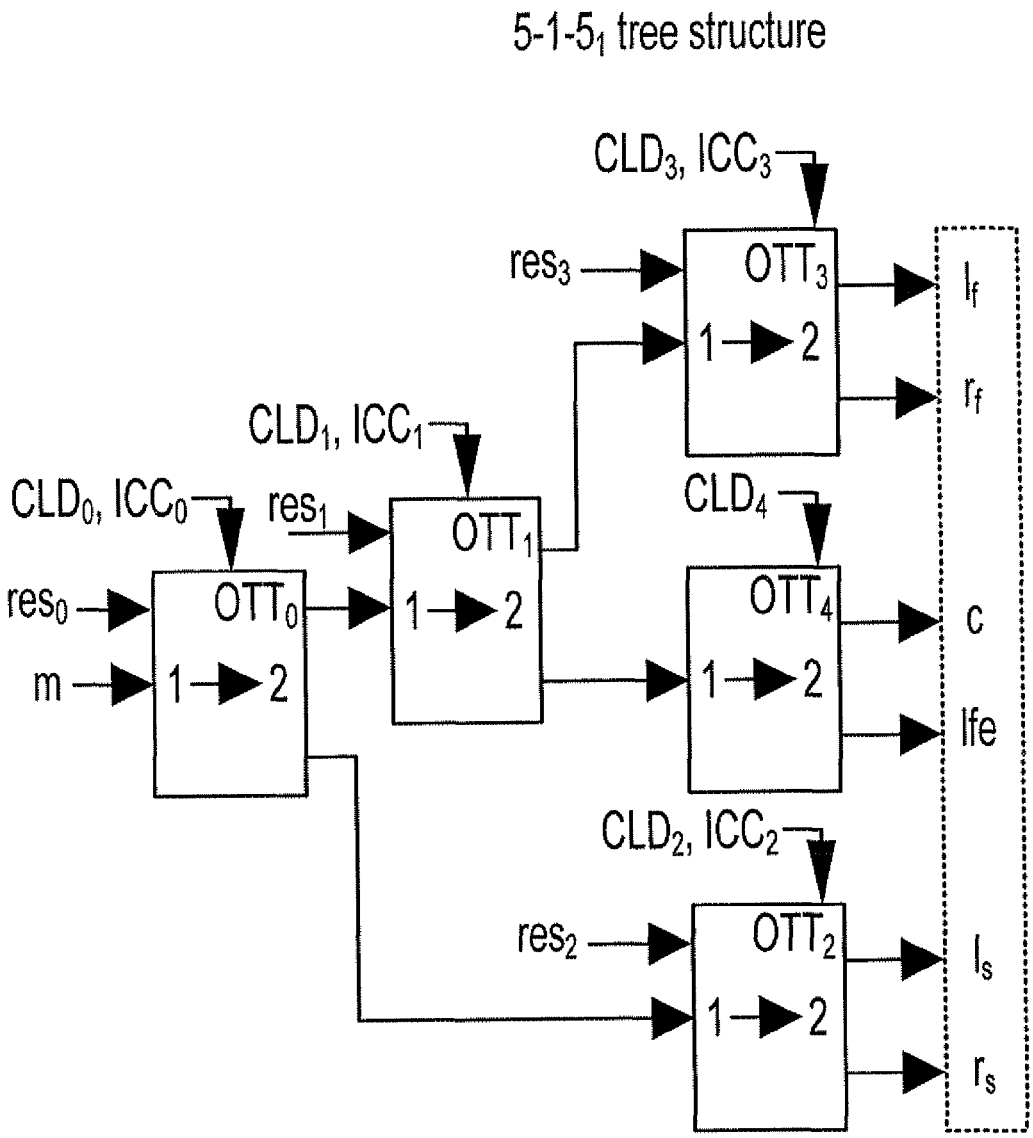
FIG. 7 is a tree structure view of the spatial audio processing for the 5-1-$5_1$ configuration.

For sake of simplicity and without departing from the essence of the invention, the 5-1-$5_1$ MPEG surround configuration is considered, as depicted in FIG. 7. The configuration comprises a plurality of connected OTT (one-to-two) boxes. Side information such as res and of spatial parameters referred to as channel level differences (CLD) and correlations (ICC) are input to the OTT boxes. m is a downmix signal of the multichannel signal.

Figure 8:
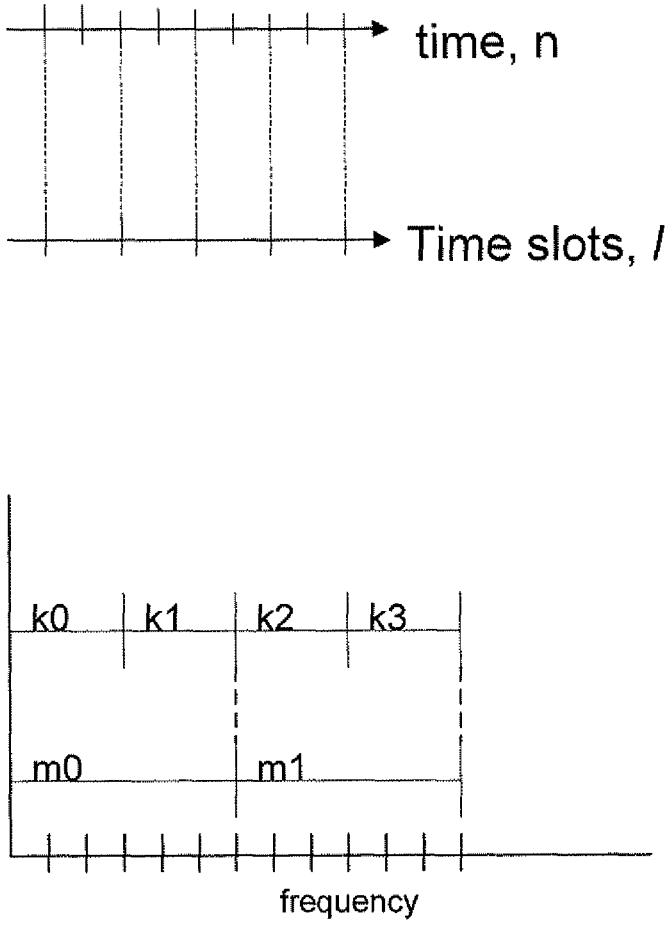
FIG. 8 illustrates the relation between subbands k and hybrid subbands m and the relation between the time-slots n and the down-sampled time slot l.

Synthesis of the multi-channel signals is done in the hybrid frequency domain. This frequency division is non linear which strives to a certain extent to mimic the time-frequency analysis of the human ear. In the following, every hybrid sub-band is indexed by k, and every time-slot is indexed by the index n. In order to lower the bit-rate requirements, the MPEG surround spatial parameters are defined only on a down-sampled time slot called the parameter time-slot l, and on a down-sampled hybrid frequency domain called the processing band m. The relations between the n and l and between the m and k are illustrated by FIG. 8. Thus the frequency band m0 comprises the frequency bands k1 and k1 and the frequency band ml comprises the frequency bands k2 and k3. Moreover, the time slots l is a downsampled version of the time slots n. The CLD and ICC parameters are therefore valid for that parameter time-slot and processing band. All processing parameters are calculated for every processing band and subsequently mapped to every hybrid band.

Thereafter, these are interpolated from the parameter time-slot to every time-slot n.

Figure 9A:
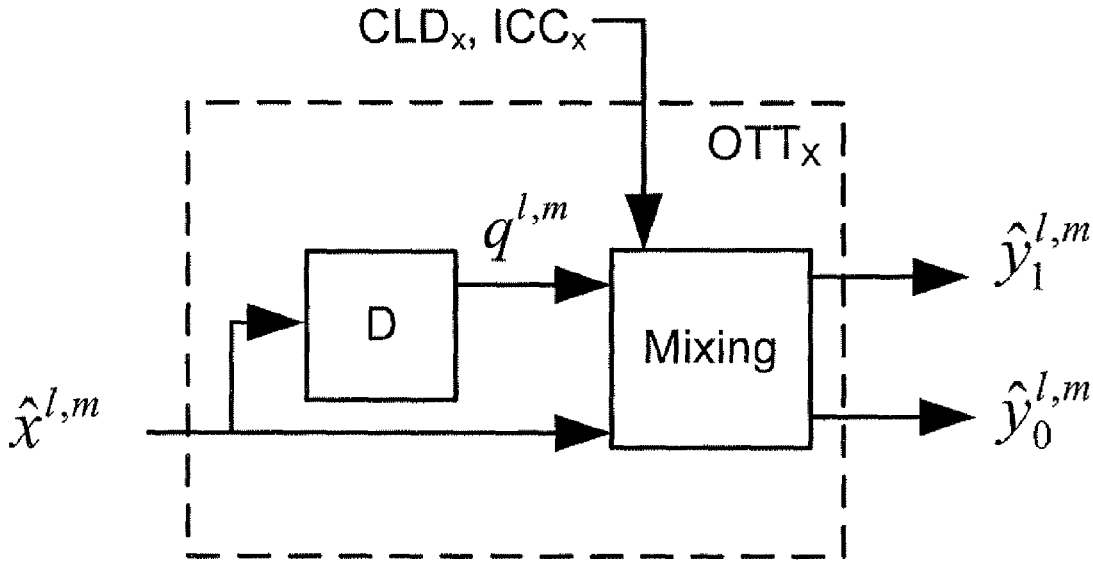
FIG. 9*a* illustrates an OTT box showed in FIG. 7

The OTT boxes of the decoder depicted in FIG. 7 can be visualized as shown in FIG. 9*a*.

Based on this illustration, the output for an arbitrary OTT box strives to restore the correlation between the two original channels $y_0^{l,m}$ and $y_1^{l,m}$ into the two estimated channels $\hat{y}_0^{l,m}$ and $\hat{y}_1^{l,m}$.

Figure 9B:
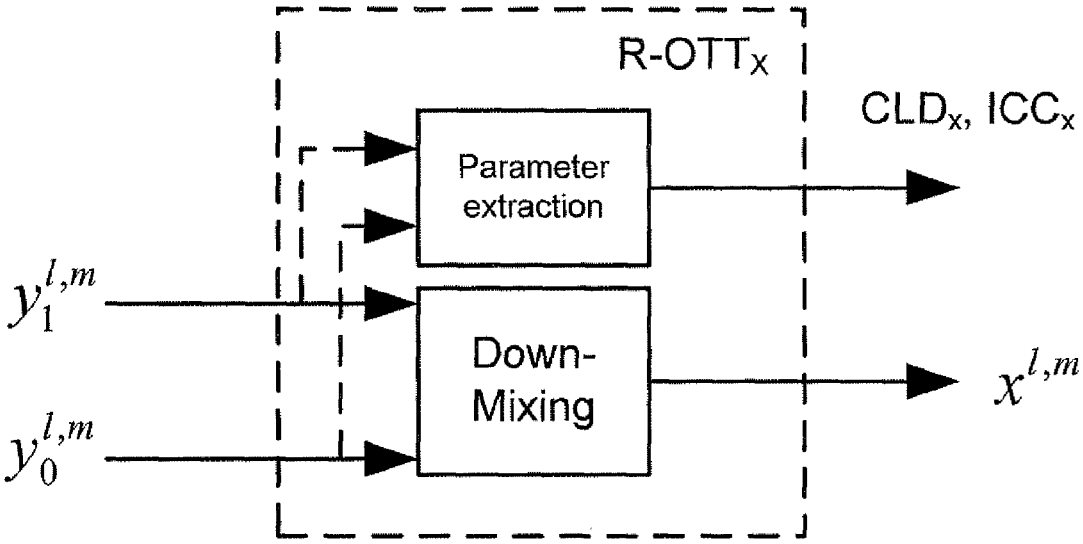
FIG. 9*b* illustrates the corresponding R-OTT box.

This can be better understood by examination of the estimation part done in the encoder. The encoder comprises R-OTT boxes that are reversed OTT boxes as illustrated in FIG. 9*b*. The R-OTT boxes convert a stereo signal into a mono signal in combination with parameter extraction which represents the spatial cues between the respective input signals. Input signals to each of these R-OTT boxes are the original channels $y_0^{l,m}$ and $y_1^{l,m}$. Each R-OTT box computes the ratio of the powers of corresponding time/frequency tiles of the input signals (which will be denoted 'Channel Level Difference', or CLD), that is given by:

$$CLD_X = 10\log_{10}\left(\frac{\sum_{l,m} y_0^{l,m} y_0^{l,m*}}{\sum_{l,m} y_1^{l,m} y_1^{l,m*}}\right)$$

and a similarity measure of the corresponding time/frequency tiles of the input signals (which will be denoted 'Inter-Channel Correlation', or ICC), given by the cross correlation:

$$ICC_X = \mathrm{Re}\left(\frac{\sum_{l,m} y_0^{l,m} y_1^{l,m*}}{\sqrt{\sum_{l,m} y_0^{l,m} y_0^{l,m*} \sum_{l,m} y_1^{l,m} y_1^{l,m*}}}\right)$$

Additionally, the R-OTT box generates a mono signal which writes as $$x^{l,m} = g_0 y_0^{l,m} + g_1 y_1^{l,m}$$

where $g_0$, $g_1$ are appropriate gains. With $g_0 = g_1 = ½$ a mono signal is generated. Another choice consists of choosing $g_0$, $g_1$ such that $$E[x^{l,m} x^{l,m*}] = E[y_0^{l,m} y_0^{l,m*}] + E[y_1^{l,m} y_1^{l,m*}]$$

which can be realized using, $$g_0 = g_1 = \sqrt{\frac{1 + 10^{\frac{CLD_X}{10}}}{1 + 10^{\frac{CLD_X}{10}} + ICC_X \cdot 10^{\frac{CLD_X}{20}}}}$$

In the following, it is assumed that the above is true and that the energy of the output of the R-OTTx box is equal to the sum of the input energies.

The correlations (ICC) as well as the channel level differences (CLD) between any two channels that are input to an R-OFT box is quantized encoded and transmitted to the decoder.

This embodiment of the invention uses the CLD and the ICC corresponding to each (R)-OTT box in order to build the spatial covariance matrix, however other measures of the correlation and the channel level differences may also be used.

Conceptually the covariance matrix of any two channels is written as:

$$C_{OTT_X} = \begin{bmatrix} E[y_0 y_0^*] & E[y_0 y_1^*] \\ E[y_1 y_0^*] & E[y_1 y_1^*] \end{bmatrix}$$

Since only real correlations are available at the MPEG-surround decoder it is possible to assume real correlation matrices without loss of generality. Thus, each output channels of an OTT box (which is input to an R-OTT box) can be shown to have a covariance matrix as $$\begin{aligned} C_{OTT_X} &= \sigma^2_{OTT_X} \\ &= \begin{bmatrix} \frac{10^{\frac{CLD_X}{10}}}{1+10^{\frac{CLD_X}{10}}} & \frac{10^{\frac{CLD_X}{20}} ICC_X}{1+10^{\frac{CLD_X}{10}}} \\ \frac{10^{\frac{CLD_X}{20}} ICC_X}{1+10^{\frac{CLD_X}{10}}} & \frac{1}{1+10^{\frac{CLD_X}{10}}} \end{bmatrix} \\ &= \sigma^2_{OTT_X} \begin{bmatrix} c_{1,x}^2 & c_{1,x}c_{2,x}\rho_x \\ c_{1,x}c_{2,x}\rho_x & c_{2,x}^2 \end{bmatrix} \end{aligned}$$

Where $\sigma_{OTT_X}^2$ denotes the energy of the input of the $OTT_X$ (or alternatively the output of the R-$OTT_X$) box, the second term on the right-hand side of the equation is shown in order to simplify the notations.

If the channels vector corresponding to the output of $OTT_3$ and $OTT_4$ are denoted $$v_{OTT_3,OTT_4} = \begin{bmatrix} lf \\ rf \\ c \\ lfe \end{bmatrix}$$

then, according to these notations, the spatial covariance matrix in the case of the 5-1-$5_1$ MPEG surround can be written with block matrices and the matrix is partially unknown which is shown below:

$$\mathrm{Re}E\left[\begin{bmatrix} lf \\ rf \\ c \\ lfe \end{bmatrix}[lf^* \;\; rf^* \;\; c^* \;\; lfe^*]\right] = \begin{bmatrix} C_{OTT_3} & ? \\ ? & C_{OTT_4} \end{bmatrix}$$

The 2×2 matrices which are unknown are marked by "?". Hence a partially known spatial covariance matrix is obtained based on the spatial parameters, CLD and ICC.

Furthermore, the input of $OTT_3$ and $OTT_4$ are related to each other and are represented by the covariance matrix $C_{OTT_1}$. It is easy in this case to relate both energies, i.e. $\sigma_{OTT_3}^2$ and $\sigma_{OTT_4}^2$ as follows, $$\sigma_{OTT_3} = c_{1,1}^2 \sigma_{OTT_1}^2,$$

$$\sigma_{OTT_4} = c_{2,1}^2 \sigma_{OTT_1}$$

Therefore the covariance matrix for the first four channels can be written as $$\mathrm{Re}E\left[\begin{bmatrix} lf \\ rf \\ c \\ lfe \end{bmatrix}[lf^* \;\; rf^* \;\; c^* \;\; lfe^*]\right] =$$

$$\sigma^2_{OTT_1} \begin{bmatrix} c_{1,1}^2 c_{1,3}^2 & c_{1,1}^2 c_{1,x} c_{2,3}\rho_3 & R_{lf,c} & R_{lf,lfe} \\ c_{1,1}^2 c_{1,3} c_{2,3}\rho_3 & c_{1,1}^2 c_{2,3}^2 & R_{rf,c} & R_{rf,lfe} \\ R_{lf,c} & R_{rf,c} & c_{2,1}^2 c_{1,4}^2 & c_{2,1}^2 c_{1,4} c_{2,4}\rho_4 \\ R_{lf,lfe} & R_{rf,lfe} & c_{2,1}^2 c_{1,4} c_{2,4}\rho_4 & c_{2,1}^2 c_{2,4}^2 \end{bmatrix}$$

In the MPEG surround standard, the value of $\rho_4 = ICC_4$ does not exist and is conceptually assumed to be equal to 1, i.e. center and LFE are identical except for a scale factor. However, for the sake of a generic development, this assumption will not be made.

The last matrix equation shows that a number of unknown spatial inter-channel correlations are present. Namely, $R_{lf,c}$, $R_{lf,lfe}$, $R_{rf,c}$, $R_{rf,lfe}$, however it is known that, the cross correlation of the two inputs to $OTT_3$ and $OTT_4$ is equal to $ICC_1 = \rho_1$. Given that, according to the previous matrix equation:

$$\mathrm{Re}E\left[\begin{bmatrix} lf + rf \\ c + lfe \end{bmatrix}[lf^* + rf^* \; c^* + lfe^*]\right] =$$

$$\begin{bmatrix} c_{1,1}^2(c_{1,3}^2 + 2c_{1,3}c_{2,3}\rho_3 + c_{2,3}^2) & R_{lf,c} + R_{lf,lfe} + R_{rf,c} + R_{rf,lfe} \\ R_{lf,c} + R_{lf,lfe} + R_{rf,c} + R_{rf,lfe} & c_{2,1}^2(c_{1,4}^2 + 2c_{1,4}c_{2,4}\rho_4 + c_{2,4}^2) \end{bmatrix}$$

Thus, it is immediately seen that the missing quantities have to satisfy $$R_{lf,c} + R_{lf,lfe} + R_{rf,c} + R_{rf,lfe} = \rho_1 \cdot c_{1,1} c_{1,2} \sqrt{(c_{1,3}^2 + 2c_{1,3}c_{2,3}\rho_3 + c_{2,3}^2)(c_{1,4}^2 + 2c_{1,4}c_{2,4}\rho_4 + c_{2,4}^2)}$$

It is also clear that this constraint alone cannot determine all the missing spatial variables.

In order to manipulate further the individual channels. This embodiment of the present invention extrapolates the missing correlation quantities while maintaining the correlation sum constraint. It should be noted that extrapolation of such a matrix must also be such that the resulting extrapolated matrix is symmetric and positive definite. This is in fact a requirement for any matrix to be admissible as a covariance matrix.

Several techniques can be used from the literature in order to extrapolate the partially known covariance matrix to obtain a complete covariance matrix. The use of one method or another is within the scope of the invention.

According to the preferred embodiment the Maximum-Entropy principle is used as extrapolation method. This leads to an easy implementation and has shown quite good performance in terms of audio quality.

Accordingly, the extrapolated correlation quantities are chosen such that they maximize the determinant of the covariance matrix, i.e.

$$\det\begin{bmatrix} c_{1,1}^2 c_{1,3}^2 & c_{1,1}^2 c_{1,x} c_{2,3}\rho_3 & R_{lf,c} & R_{lf,lfe} \\ c_{1,1}^2 c_{1,3} c_{2,3}\rho_3 & c_{1,1}^2 c_{2,3}^2 & R_{rf,c} & R_{rf,lfe} \\ R_{lf,c} & R_{rf,c} & c_{2,1}^2 c_{1,4}^2 & c_{2,1}^2 c_{1,4} c_{2,4}\rho_4 \\ R_{lf,lfe} & R_{rf,lfe} & c_{2,1}^2 c_{1,4} c_{2,4}\rho_4 & c_{2,1}^2 c_{2,4}^2 \end{bmatrix}$$

Under the constraint that, $$R_{lf,c}+R_{lf,lfe}+R_{rf,c}+R_{rf,lfe}=\frac{\rho_1 \cdot c_{1,1} c_{1,2}}{\sqrt{(c_{1,3}^2+2c_{1,3}c_{2,3}\rho_3+c_{2,3}^2)(c_{1,4}^2+2c_{1,4}c_{2,4}\rho_4+c_{2,4}^2)}}$$

This is a convex optimization problem and a closed form solution exists. In order to simplify the notation we will derive the solution for a generic covariance matrix, $$\Gamma = \begin{bmatrix} R_{lf,lf} & R_{lf,rf} & R_{lf,c} & R_{lf,lfe} \\ R_{lf,rf} & R_{rf,rf} & R_{rf,c} & R_{rf,lfe} \\ R_{lf,c} & R_{rf,c} & R_{c,c} & R_{c,lfe} \\ R_{lf,lfe} & R_{rf,lfe} & R_{c,lfe} & R_{lfe,lfe} \end{bmatrix}$$

First it should be noted that maximizing the determinant of Γ is also equivalent to maximizing the determinant of the following matrix $$\Gamma' = \begin{bmatrix} 1 & 1 & 0 & 0 \\ 1 & -1 & 0 & 0 \\ 0 & 0 & 1 & 1 \\ 0 & 0 & 1 & -1 \end{bmatrix} \begin{bmatrix} R_{lf,lf} & R_{lf,rf} & R_{lf,c} & R_{lf,lfe} \\ R_{lf,rf} & R_{rf,rf} & R_{rf,c} & R_{rf,lfe} \\ R_{lf,c} & R_{rf,c} & R_{c,c} & R_{c,lfe} \\ R_{lf,lfe} & R_{rf,lfe} & R_{c,lfe} & R_{lfe,lfe} \end{bmatrix} \begin{bmatrix} 1 & 1 & 0 & 0 \\ 1 & -1 & 0 & 0 \\ 0 & 0 & 1 & 1 \\ 0 & 0 & 1 & -1 \end{bmatrix} = \begin{bmatrix} R_{fm,fm} & R_{fm,fs} & R_{fm,cm} & R_{fm,cs} \\ R_{fm,fs} & R_{fs,fs} & R_{fs,cm} & R_{fs,cs} \\ R_{fm,cm} & R_{fs,cm} & R_{cm,cm} & R_{cm,cs} \\ R_{fs,cs} & R_{rf,lfe} & R_{cm,cs} & R_{cs,cs} \end{bmatrix}$$

This is also equivalent to evaluating the covariance matrix of the mono and side channel obtained from the center channels (C and LFE) and the front channels (FL,FR), namely, $$\begin{bmatrix} fm \\ fs \\ cm \\ cs \end{bmatrix} = \begin{bmatrix} 1 & 1 & 0 & 0 \\ 1 & -1 & 0 & 0 \\ 0 & 0 & 1 & 1 \\ 0 & 0 & 1 & -1 \end{bmatrix} \begin{bmatrix} lf \\ rf \\ c \\ lfe \end{bmatrix}$$

Now clearly the constraint on the matrix Γ easily translates to $$R_{fm,cm}=\frac{\rho_1 \cdot c_{1,1} c_{1,2}}{\sqrt{(c_{1,3}^2+2c_{1,3}c_{2,3}\rho_3+c_{2,3}^2)(c_{1,4}^2+2c_{1,4}c_{2,4}\rho_4+c_{2,4}^2)}}$$

The remaining unknown correlations are $R_{fm,cs}$, $R_{fs,cm}$ and $R_{fm,cs}$ are extrapolated by using the maximization of the determinant of Γ', the computation steps are quite cumbersome, but the results are in the end quite simple and lead to the following closed-form formulas:

$$R_{fm,cs} = \frac{R_{fm,cm} R_{cm,cs}}{R_{cm,cm}},$$

$$R_{fs,cm} = \frac{R_{fm,fs} R_{fm,cm}}{R_{fm,fm}},$$

$$R_{fs,cs} = \frac{R_{fm,fs} R_{fm,cm} R_{cm,cs}}{R_{fm,fm} R_{cm,cm}}$$

These quantities can therefore be extrapolated quite easily from the available data. Finally, the complete extrapolated covariance matrix Γ a simple matrix multiplication, is needed;

$$\begin{bmatrix} R_{lf,lf} & R_{lf,rf} & R_{lf,c} & R_{lf,lfe} \\ R_{lf,rf} & R_{rf,rf} & R_{rf,c} & R_{rf,lfe} \\ R_{lf,c} & R_{rf,c} & R_{c,c} & R_{c,lfe} \\ R_{lf,lfe} & R_{rf,lfe} & R_{c,lfe} & R_{lfe,lfe} \end{bmatrix} =$$

$$\frac{1}{4}\begin{bmatrix} 1 & 1 & 0 & 0 \\ 1 & -1 & 0 & 0 \\ 0 & 0 & 1 & 1 \\ 0 & 0 & 1 & -1 \end{bmatrix} \begin{bmatrix} R_{fm,fm} & R_{fm,fs} & R_{fm,cm} & R_{fm,cs} \\ R_{fm,fs} & R_{fs,fs} & R_{fs,cm} & R_{fs,cs} \\ R_{fm,cm} & R_{fs,cm} & R_{cm,cm} & R_{cm,cs} \\ R_{fs,cs} & R_{rf,lfe} & R_{cm,cs} & R_{cs,cs} \end{bmatrix} \begin{bmatrix} 1 & 1 & 0 & 0 \\ 1 & -1 & 0 & 0 \\ 0 & 0 & 1 & 1 \\ 0 & 0 & 1 & -1 \end{bmatrix}$$

These steps are also be applied in order to extrapolate the total covariance matrix of the additional two channels, i.e. KS and RS. Leading to the total extrapolated covariance matrix:

$$\mathrm{Re}E\begin{bmatrix} lf \\ rf \\ c \\ lfe \\ ls \\ rs \end{bmatrix} [lf^* rf^* c^* lfe^* ls^* rs^*] \begin{bmatrix} R_{lf,lf} & R_{lf,rf} & R_{lf,c} & R_{lf,lfe} & R_{lf,ls} & R_{lf,rs} \\ R_{lf,rf} & R_{rf,rf} & R_{rf,c} & R_{rf,lfe} & R_{rf,ls} & R_{rf,rs} \\ R_{lf,c} & R_{rf,c} & R_{c,c} & R_{c,lfe} & R_{c,ls} & R_{c,rs} \\ R_{lf,flc} & R_{rf,lfe} & R_{c,lfe} & R_{lfe,lfe} & R_{lfe,ls} & R_{lfe,rs} \\ R_{lf,ls} & R_{rf,ls} & R_{c,ls} & R_{lfe,ls} & R_{ls,ls} & R_{ls,rs} \\ R_{lf,rs} & R_{rf,rs} & R_{c,rs} & R_{lfe,rs} & R_{ls,rs} & R_{rs,rs} \end{bmatrix}$$

By using the same approach, i.e. converting the channels to virtual mono and side channels, it is quite easy to derive closed form formulas for the extrapolated covariance matrices.

So far, what has presented is a two step approach where the partial covariance matrix of the channels [lf rf c lfe] is first extrapolated and then the total covariance matrix of all channels is then extrapolated. However, another approach would consist in computing the total incomplete covariance matrix and then to globally extrapolate all correlations. The two approaches are conceptually equivalent. The second approach is however more effective since it globally extrapolates all possible correlations while the former implies a two step approach.

Both approaches are similar in implementation and are based on the maximum entropy (i.e. determinant maximization) approach.

It should be noted that all quantities depend both on time and frequency. The indexing was omitted for sake of clarity. The time index corresponds to the parameter time-slot l, while the frequency index to the processing band index m. Finally it should also be pointed out that all the resulting correlations will be defined relatively to the energy of the mono down mix signal, which is represented by a $\sigma_{OTT_0}$. This is in fact true for any $OTT_x$ box, due to the presence of the term $\sigma_{OTT_X}^2$.

In the following, in order to simplify the notation the mono downmix energy normalized extrapolated covariance matrix is defined as $$\tilde{C}^{l,m} = \frac{1}{\sigma^2_{OTT_0}(l,m)}\mathrm{Re}E\left[\begin{bmatrix} lf \\ rf \\ c \\ lfe \\ ls \\ rs \end{bmatrix}[lf^* rf^* c^* lfe^* ls^* rs^*]\right]$$

The estimation and the synthesis of arbitrary channels based on extrapolated covariance matrix is described below.

Suppose that arbitrary channels defined as a predetermined arbitrary linear combination of the original channels are to be decoded/synthesized, for example $$a^{n,k} = H^k \begin{bmatrix} lf^{k,n} \\ rf^{k,n} \\ c^{k,n} \\ lfe^{k,n} \\ ls^{k,n} \\ rs^{k,n} \end{bmatrix}$$

Where the matrix $H^k$ denotes a matrix of coefficients representing a description of predetermined arbitrary linear combination and $a^{n,k}$, is the desired linear combination, i.e. desired output signal. The prior art direct technique would directly compute $\hat{a}^{n,k}$ as a simple linear combination of the output of the decoder, i.e. to apply the matrix $H^k$ in the frequency domain to the decoded channels $\hat{lf}^{k,n}$, $\hat{rf}^{k,n}$, $\hat{c}^{k,n}$, $\hat{lfe}^{k,n}$, $\hat{ls}^{k,n}$, $\hat{rs}^{k,n}$, formally this would write as $$\hat{a}^{n,k} = H^k \begin{bmatrix} \hat{lf}^{k,n} \\ \hat{rf}^{k,n} \\ \hat{c}^{k,n} \\ \hat{lfe}^{k,n} \\ \hat{ls}^{k,n} \\ \hat{rs}^{k,n} \end{bmatrix}$$

Which would limit the quality on the output and may cause unwanted channel correlations as well as possible cancellations.

As stated earlier, the output of each R-OTT box leads to a linear combination. Thus, it is easily seen that the downmix signal is in fact a linear combination of all channels.

The downmix signal denoted $m^{k,n}$ can therefore be written as:

$$m^{n,k} = W^{n,k}\begin{bmatrix} lf^{n,k} \\ rf^{n,k} \\ c^{n,k} \\ lfe^{n,k} \\ ls^{n,k} \\ rs^{n,k} \end{bmatrix} = [w^{n,k}_{lf}\, w^{n,k}_{rf}\, w^{n,k}_{c}\, w^{n,k}_{lfe}\, w^{n,k}_{ls}\, w^{n,k}_{rs}]\begin{bmatrix} lf^{n,k} \\ rf^{n,k} \\ c^{n,k} \\ lfe^{n,k} \\ ls^{n,k} \\ rs^{n,k} \end{bmatrix},$$

The $W^{n,k}$ matrix of coefficients is known and is dependent only on the received CLDx parameters. In the case of a single channel downmix, i.e. the downmix signal consists of a mono only signal, then the matrix $W^{n,k}$ is indeed a row vector as shown in the above equation. The problem can then be stated in terms of a least mean squares problem, or in general as a weighted least mean squares problem.

Given the mono down mix signal $m^{n,k}$, a linear estimate of the channels $A^{n,k}$ can be formed as:

$\hat{a}^{n,k}=Q^{n,k}m^{n,k}$, where $Q^{n,k}$ is a matrix which needs to be optimized such as when it is applied to the downmix channels, in this case the mono channel $m^{n,k}$, it should provide a result as close as the one obtained with the original linear combination, $a^{n,k}$.

The objective is therefore to minimize the error $e^{n,k}=a^{n,k}-\hat{a}^{n,k}$ with respect to some fidelity criterion, in this case the mean square error criterion. This leads to minimization of $$e^{n,k} = H^k \begin{bmatrix} lf^{k,n} \\ rf^{k,n} \\ c^{k,n} \\ lfe^{k,n} \\ ls^{k,n} \\ rs^{k,n} \end{bmatrix} - Q^{n,k}W^{n,k}\begin{bmatrix} lf^{k,n} \\ rf^{k,n} \\ c^{k,n} \\ lfe^{k,n} \\ ls^{k,n} \\ rs^{k,n} \end{bmatrix} = (H^k - Q^{n,k}W^{n,k})\begin{bmatrix} lf^{k,n} \\ rf^{k,n} \\ c^{k,n} \\ lfe^{k,n} \\ ls^{k,n} \\ rs^{k,n} \end{bmatrix}$$

Assuming that the matrices are stationary, i.e. that they can be factored out of the averaging operator, the mean squares solution to this problem can easily be solved with respect to $Q^{n,k}$ resulting in $$Q^{n,k} = \frac{H^k C^{n,k} W^{n,k*}}{W^{n,k} C^{n,k} W^{n,k*}}$$

The matrix $C^{n,k}$ denotes the covariance matrix of the channels, i.e.

$$C^{n,k} = E\left[\begin{bmatrix} lf^{k,n} \\ rf^{k,n} \\ c^{k,n} \\ lfe^{k,n} \\ ls^{k,n} \\ rs^{k,n} \end{bmatrix}[lf^* rf^* c^* lfe^* ls^* rs^*]\right]$$

Which, as discussed earlier, may not be available at the decoder but which is extrapolated according to the technique described previously. Here the covariance matrix is shown to be complex. However, since only the real correlations are used, it can be easily shown that the result is still valid with real covariance matrices.

So far it have been shown that the least mean square is estimated for every hybrid sub-band k and every time slot n. In reality, a substantial amount of complexity reduction can be made by computing the mean square estimate on a certain number of time slots and then use interpolation in order to extend this to all time slots. For instance, it is beneficial to map the estimation onto the same time slots as those used for the parameters, i.e. to compute the covariance matrix only for the parameters time-slots, index l. The same technique for complexity reduction could be used by mapping the mean square estimate to be computed only for the parameter bands, index m. However, in general this is not as straightforward as for the time index since a certain amount of frequency resolution may be needed in order to efficiently represent the action of the matrix $H^k$. In the following the sub-sampled parameter domain, i.e. l,m, is considered.

As already stated earlier, the covariance matrix $C^{l,m}$ is known only relatively to the energy of the mono downmix signal, i.e. $\sigma_{OTT_0}^2(l,m)$. Because of this constraint, it can be easily shown that $W^{l,m}C^{l,m}W^{l,m*}=\sigma_{OTT_0}^2(l,m)$ for all l,m. The least mean square estimate can therefore be written as $$Q^{l,m}=H^{m}\tilde{C}^{l,m}W^{l,m*}$$

It should be noted that $Q^{l,m}$ depends only on know quantities which are available in the decoder. In fact, $H^m$ is an external input, a matrix, describing the desired linear combination, while $\tilde{C}^{l,m}$ and $W^{l,m}$ are derived from the spatial parameters contained in the received bit stream.

The least squares estimate inherently introduces a loss in energy that can have negative effects on the quality of the synthesized channels. The loss of energy is due to the mismatch between the model when applied to the decoded signal and the real signal. In least squares terminology, this is called the noise subspace. In spatial hearing this term is called the diffuse sound field, i.e. the part of the multichannel signal which is uncorrelated or diffuse. In order to circumvent this, a number of decorrelated signals are used in order to fill the noise subspace and diffuse sound part and therefore to get an estimated signal which is psycho-acoustically similar to the wanted signal.

Because of the orthogonal properties of least mean squares, the energy of the desired signal can be expressed as:

$$E[a^{n,k}a^{n,k*}]=E[\hat{a}^{n,k}\hat{a}^{n,k*}]+E[e^{n,k}e^{n,k*}]$$

Thus the normalized covariance matrix of the error in the l, m domain can be expressed as $$H^{m}\tilde{C}^{l,m}H^{m*}-Q^{l,m}W^{l,m}\tilde{C}^{l,m}W^{l,m*}Q^{l,m*}$$

In order to generate an estimated signal, $\tilde{a}^{n,k}$, which has the same psycho-acoustical characteristics as the desired signal $a^{n,k}$ an error signal independent from $\hat{a}^{n,k}$ is generated. The error signal must have a covariance matrix which is close to that of the true error signal $E[e^{n,k}e^{n,k*}]$ and it also has to be uncorrelated from the mean squares estimate $\hat{a}^{n,k}$.

The artificial error signal, denoted by $\tilde{e}^{n,k}$ is then added to the mean square error estimate in order to form the final estimate, $\tilde{a}^{n,k}=\hat{a}^{n,k}+\tilde{e}^{n,k}$.

One way of generating a signal similar to the error signal is through the use of the decorrelation applied to the mono down-mix signal, This guarantees that the error signal is uncorrelated from the mean square estimate since $\hat{a}^{n,k}$ is directly dependent on the mono downmix signal. However this is insufficient in itself, the decorrelators need to be spatially shaped such that their covariance matrix matches the correlation of the true error signal $E[e^{n,k}e^{n,k*}]$.

A simple way to do this is to force the generated decorrelated signals to be uncorrelated also between themselves and then to apply a correlation shaping matrix referred to as $Z^{n,k}$. If $d^{n,k}$ is denoted to be the vector output of the decorrelators, then the shaping matrix $Z^{n,k}$ has to fulfill, $$Z^{n,k}E[d^{n,k}d^{n,k*}]Z^{n,k*}=E[e^{n,k}e^{n,k*}]$$

However, because $E[e^{n,k}e^{n,k*}]$ is defined only as the normalized covariance matrix, (relative to the energy of the mono downmix signal) the decorrelators have also to have a covariance matrix which is relatively defined to that of the mono downmix energy.

In accordance with prior art, a simple way to ensure this is to use all-pass filtering decorrelation thus leading to a normalized (with respect to the mono signal energy) covariance matrix which writes as, $E[d^{n,k}d^{n,k*}]=I$, i.e. the identity matrix and then apply a shaping matrix $Z^{n,k}$.

It can be easily seen that a simple Cholesky factorization of $E[e^{n,k}e^{n,k*}]=Z^{n,k}Z^{n,k*}$ can produce a suitable matrix $Z^{n,k}$. Of course another factorization is also possible, e.g. by using the Eigen-vectors and Eigen-values of the normalized error covariance matrix. In addition, an advantage is obtained by evaluating the matrix $Z^{n,k}$ only in the parameter domain, i.e. l,m.

Finally, the total synthesis can be written as:

$$\tilde{a}^{n,k}=Q^{n,k}m^{n,k}+Z^{n,k}d^{n,k}$$

Where the matrix $Q^{n,k}$ is obtained by interpolating the matrix $Q^{l,m}=H^{m}\tilde{C}^{l,m}W^{l,m*}$ in the time domain (i.e. from l to n) and by mapping the sub-band parameter bands to the hybrid bands (i.e. from m to k).

And similarly the matrix $Z^{n,k}$ is obtained by interpolating and mapping the matrix $Z^{l,m}$ defined by the equation $$Z^{n,k}Z^{n,k*}=H^{m}\tilde{C}^{l,m}H^{m*}-Q^{l,m}W^{l,m}\tilde{C}^{l,m}W^{l,m*}Q^{l,m*}$$

Figure 10B:
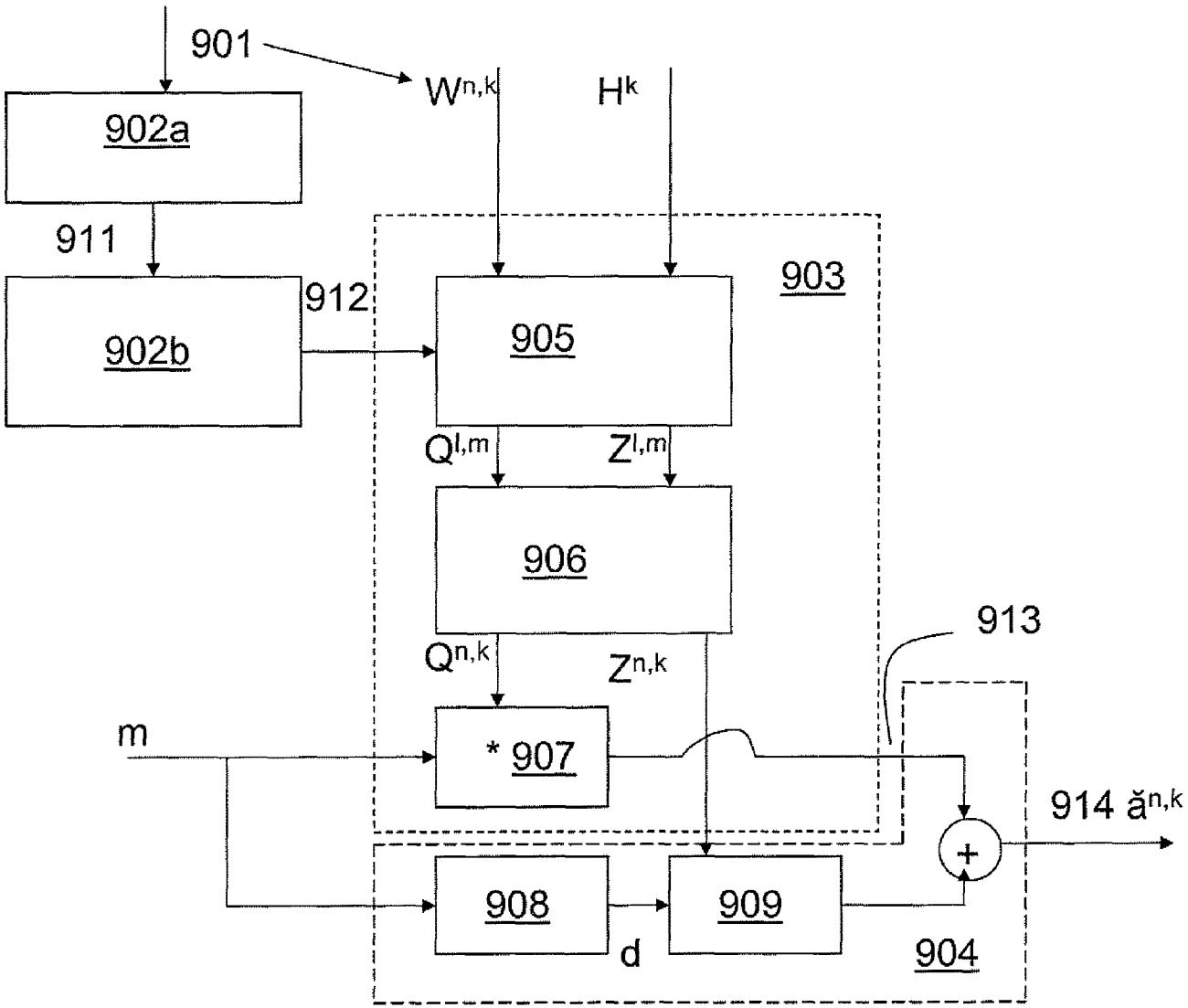

FIG. 10*b*, summarizes and illustrates the arrangement used in order to synthesize arbitrary channels according to an embodiment of the present invention described above. The reference signs correspond to the reference signs of FIG. 10*a*. In this embodiment the estimator 903 comprises a unit 905 configured to determine a matrix Q by minimizing a mean square error (i.e. $e^{n,k}=a^{n,k}-\hat{a}^{n,k}$) between the estimated linear combination of the multi-channel surround audio signal and the arbitrary predetermined linear combination of the multichannel surround audio signal. It should be noted that one does not have to have access to the arbitrary predetermined linear combination of the multichannel surround sound signal, it is enough to have knowledge of the covariance matrix of the original multichannel signals in order to form an estimate of the said linear combination of the multichannel surround sound signal. The latter is obtained from the received bit stream through forming a partially known covariance matrix and then extrapolating it by the use of principles such as the maximum entropy principle.

Moreover, the estimator 903 comprises a further unit 907 configured to multiply $Q^{n,k}$ with the downmix signal to obtain the estimate 913 of the linear combination of a multi-channel surround audio signal. The estimator 913 further comprises a unit 905 adapted to determine a decorrelated signal shaping matrix $Z^{n,k}$ indicative of the amount of decorrelated signals. In this embodiment, the synthesizer 904 is configured to synthesize the linear combination by computing 908, 909 $Z^{n,k*}d^{n,k}$, and then $\tilde{a}^{n,k}=Q^{n,k}m^{n,k}+Z^{n,k}d^{n,k}$, where $d^{n,k}$ is "a decorrelation signal", for each frequency band and each time slot to compensate for energy losses. Further, the arrangement also comprises an interpolating and mapping unit 906. This unit can be configured to interpolate the matrix $Q^{l,m}$ in the time domain and to map downsampled frequency bands m to hybrid bands k and to interpolate the matrix $Z^{l,m}$ in the time domain and to map downsampled frequency bands m to hybrid bands k. The extrapolator 902*b* may as stated above use the Maximum-Entropy principle by selecting extrapolated correlation quantities such that they maximize the determinant of the covariance matrix under a predetermined constraint.

Figure 11:
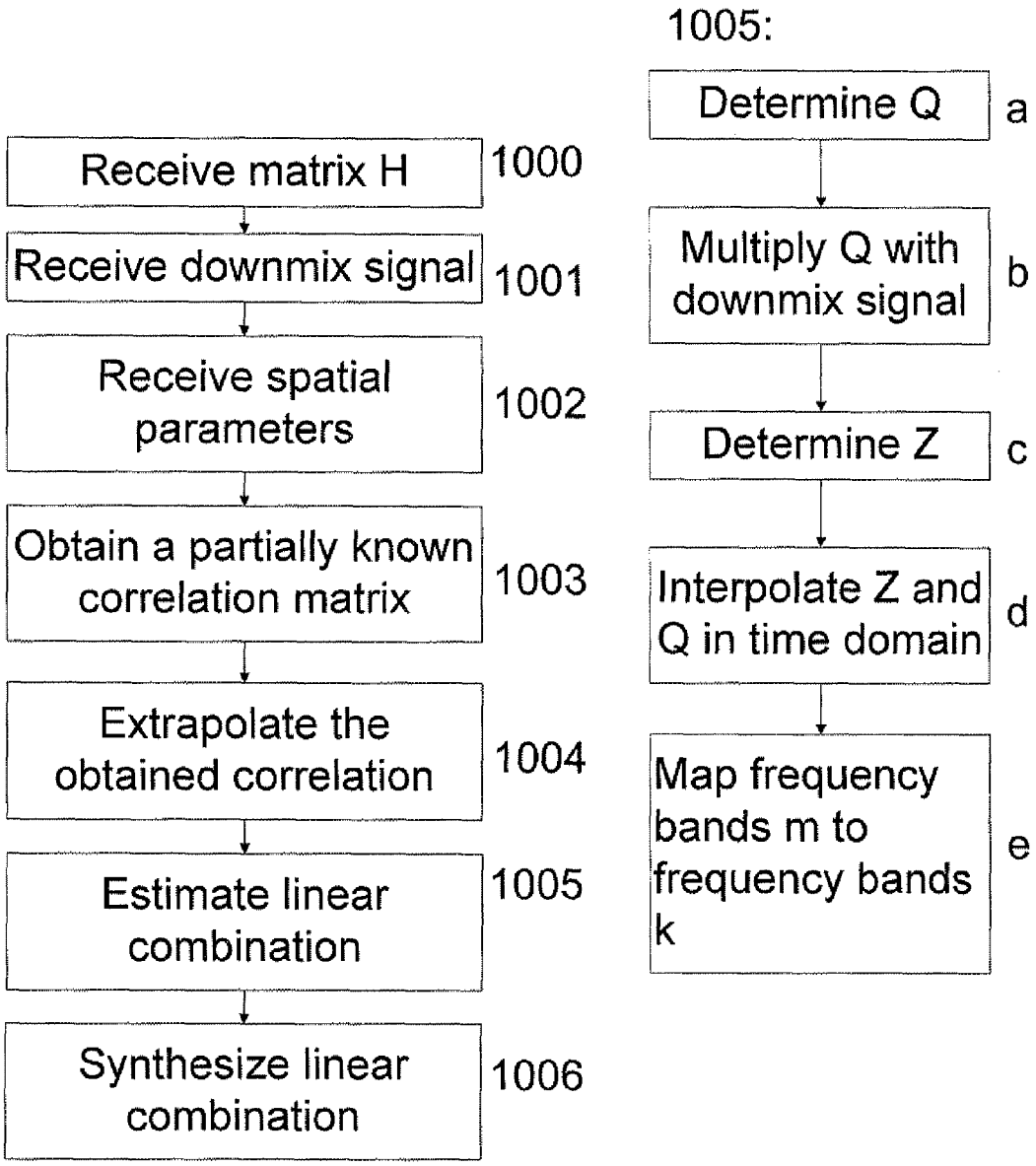
FIG. 11 is flowcharts illustrating the method according to an embodiment of the present invention.

Turning now to FIG. 11 showing a flowchart of an embodiment of the present invention. The method comprises the steps of:

1000. Receive a description H of the arbitrary predetermined linear combination.

1001. Receive a decoded downmix signal of the multi-channel surround audio signal.

1002. Receive spatial parameters comprising correlations and channel level differences of the multi-channel audio signal.

1003. Obtain a partially known spatial covariance matrix based on the received spatial parameters comprising correlations and channel level differences of the multi-channel audio signal.

1004. Extrapolate the partially known spatial covariance matrix to obtain a complete spatial covariance matrix,

1005. Form according to a fidelity criterion an estimate of said arbitrary predetermined linear combination of the multi-channel surround audio signal based at least on the extrapolated complete spatial covariance matrix, the received decoded downmix signal and the said description of the arbitrary predetermined linear combination.

1006. Synthesize said arbitrary predetermined linear combination of a multi-channel surround audio signal based on said estimate of the arbitrary predetermined linear combination of the multi-channel surround audio signal.

Step 1005 may comprise the further steps of:

1005*a*. Determine a matrix Q by minimizing a mean square error between the estimated linear combination of the multi-channel surround audio signal and the arbitrary predetermined linear combination of the multi-channel surround audio signal.

1005*b*. Multiply Q with the downmix signal to obtain the estimate of the arbitrary predetermined linear combination of a multi-channel surround audio signal.

1005*c*. Determine a decorrelated signal shaping matrix Z indicative of the amount of decorrelated signals.

1005*d*, Interpolate Q and Z in the time domain.

1005*e*. Map downsampled frequency bands m to hybrid bands k.

The method may be implemented in a decoder of a mobile terminal.

The present invention is not limited to the above-described preferred embodiments. Various alternatives, modifications and equivalents may be used. Therefore, the above embodiments should not be taken as limiting the scope of the invention, which is defined by the appending claims.

Abbreviations

| | |
|---|---|
| AAC | Advanced Audio Coding |
| AMR–WB+ | extended adaptive multirate wide band |
| C | Center |
| CLD | channel level differences |
| HR | Head Related |
| HRF | Head Related Filters |
| HRTF | Head Related Transfer Function |
| IC | inter-channel coherence |
| ICC | correlation |
| ILD | inter-channel level differences |
| ITD | inter-channel time differences |
| L | left |
| LFE | low frequency element |
| MPEG | Moving Picture Experts Group |
| OTT | One-to-two |
| PCM | Pulse Code Modulation |
| PDA | Personal Digital assistant |
| R | right |
| R-OTT | Reversed one-to-two |
| SL | surround left |
| SR | Surround Right |

The invention claimed is:

1. A method for synthesizing an arbitrary predetermined linear combination of a multi-channel surround audio signal comprising the steps of:

receiving a description H of the arbitrary predetermined linear combination receiving a decoded downmix signal of the multi-channel surround audio signal, receiving spatial parameters comprising correlations and channel level differences of the multi-channel audio signal, further comprising the steps of:

obtaining a partially known spatial covariance based on the received spatial parameters comprising correlations and channel level differences of the multi-channel audio signal, extrapolating the partially known spatial covariance to obtain a complete spatial covariance, forming according to a fidelity criterion an estimate of said arbitrary predetermined linear combination of the multi-channel surround audio signal based at least on the extrapolated complete spatial covariance, the received decoded downmix signal and the said description of the arbitrary predetermined linear combination, and synthesizing said arbitrary predetermined linear combination of a multichannel surround audio signal based on said estimate of the arbitrary predetermined linear combination of the multi-channel surround audio signal.

2. The method according to claim 1, wherein the estimating step comprises the further steps of:

determining a Q by minimizing a mean square error between the estimated linear combination of the multi-channel surround audio signal and the arbitrary predetermined linear combination of the multi-channel surround audio signal, and multiplying Q with the downmix signal to obtain the estimate of the arbitrary predetermined linear combination of a multi-channel surround audio signal.

3. The method according to claim 2, wherein the estimating step comprises the further step of:

determining a decorrelated signal shaping Z indicative of the amount of decorrelated signals.

4. The method according to claim 3, wherein the synthesizing step comprises the step of performing Q*m+Z*"a decorrelation_signal" for each frequency band and each time slot to compensate for energy losses.

5. The method according to claim 4, wherein the partial known covariance is extrapolated in a downsampled time slot l and on a downsampled frequency band m.

6. The method according to claim 5 comprising the further step of:

interpolating the Q in the time domain and mapping downsampled frequency bands m to hybrid bands k.

7. The method according to claim 2 wherein the partial known covariance is extrapolated in a downsampled time slot l and on a downsampled frequency band m.

8. The method according to claim 7, comprising the further step of:

interpolating the Z in the time domain and mapping downsampled frequency bands m to hybrid bands k.

9. The method of claim 1, wherein the extrapolating step is performed by using the Maximum-Entropy principle by:

selecting extrapolated correlation quantities such that they maximize the determinant of the covariance under a predetermined constraint.

10. The method according to claim 1, wherein it is being implemented in a decoder of a mobile terminal.

11. An arrangement for synthesizing an arbitrary predetermined linear combination of a multi-channel surround audio signal comprising:

a correlator for obtaining a partially known spatial covariance based on received spatial parameters comprising correlations and channel level differences of the multi-channel audio signal, an extrapolator for extrapolating the partially known spatial covariance to obtain a complete spatial covariance, an estimator for forming according to a fidelity criterion an estimate of said arbitrary predetermined linear combination of the multi-channel surround audio signal based at least on the extrapolated complete spatial covariance, a received decoded downmix signal and a H representing a description of the coefficients giving the arbitrary predetermined linear combination, and a synthesizer for synthesizing said arbitrary predetermined linear combination of a multi-channel surround audio signal based on said estimate of the arbitrary predetermined linear combination of the multichannel surround audio signal.

12. The arrangement according to claim 11, wherein the estimator further comprises:

means for determining a Q by minimizing a mean square error between the estimated linear combination of the multi-channel surround audio signal and the arbitrary predetermined linear combination of the multi-channel surround audio signal, and means for multiplying Q with the downmix signal to obtain the estimate of the arbitrary predetermined linear combination of a multi-channel surround audio signal.

13. The arrangement according to claim 12, wherein the estimator further comprises:

means for determining a decorrelated signal shaping Z indicative of the amount of decorrelated signals.

14. The arrangement according to claim 13, wherein the synthesizer further comprises means for performing Q*m+Z*"a decorrelation_signal" for each frequency band and each time slot to compensate for energy losses.

15. The arrangement according to claim 14, wherein that the extrapolator comprises means for extrapolating the partial known covariance in a downsampled time slot it and on a downsampled frequency band m.

16. The arrangement according to claim 15, wherein the estimator further comprises means for interpolating the Q in the time domain and mapping downsampled frequency bands m to hybrid bands k.

17. The arrangement according to claim 12, wherein the extrapolator comprises means for extrapolating the partial known covariance in a downsampled time slot l and on a downsampled frequency band m.

18. The arrangement according to claim 17, wherein the estimator further comprises means for interpolating the Z in the time domain and mapping downsampled frequency bands m to hybrid bands k.

19. The arrangement of claim 11, wherein the extrapolator comprises means for performing the extrapolation by using the Maximum-Entropy principle by:

selecting extrapolated correlation quantities such that they maximize the determinant of the covariance under a predetermined constraint.

20. The arrangement according to claim 11, wherein it is being implemented in a decoder of a mobile terminal.

* * * * *